US005090676A

United States Patent [19]

Matsuno et al.

[11] Patent Number: 5,090,676

[45] Date of Patent: Feb. 25, 1992

[54] METHOD OF AND APPARATUS FOR SEPARATING AND FEEDING SHEETS

[75] Inventors: Junichi Matsuno, Toride; Tsuyoshi Ogasawara, Ibaraki; Masataka Kawauchi, Ishioka, all of Japan

[73] Assignees: Hitachi, Ltd., Tokyo; Hitachi Koki Co., Ltd., Chiyoda, both of Japan

[21] Appl. No.: 404,873

[22] Filed: Sep. 8, 1989

[30] Foreign Application Priority Data

Sep. 19, 1988 [JP] Japan ..... 63-232472

[51] Int. Cl.[5] ..... B65H 3/12

[52] U.S. Cl. ..... 271/12; 271/94; 271/98; 271/111; 271/270

[58] Field of Search ..... 271/94, 98, 111, 270, 271/110, 12, 12, 94, 98, 110, 111, 270

[56] References Cited

U.S. PATENT DOCUMENTS

| | | | |
|---|---|---|---|
| 4,627,605 | 12/1986 | Roller | 271/98 X |
| 4,635,921 | 1/1987 | Thomas | 271/98 X |
| 4,699,369 | 10/1987 | Zirilli | 271/98 X |
| 4,768,769 | 9/1988 | Roller | 271/98 X |
| 4,887,805 | 12/1989 | Herbert | 271/98 X |

FOREIGN PATENT DOCUMENTS 2041887 9/1980 United Kingdom .

*Primary Examiner*—Richard A. Schacher

*Attorney, Agent, or Firm*—Antonelli, Terry, Stout & Kraus

[57] ABSTRACT

A sheet separating and feeding apparatus has a separating device and a vacuum-attracting device to separate and feed sheets one by one from piled sheets. The separating device includes a compressed air plenum chamber, and main nozzles, first auxiliary nozzles and second auxiliary nozzles which are provided on the compressed air plenum chamber for causing air to blow to an upper portion of the piled sheets to separate the uppermost sheet from the remaining sheets. The vacuum-attracting device includes a vacuum chamber and an endless belt having a plurality of through holes provided in a part of the belt. The endless belt rotates around the vacuum chamber, and attracts the uppermost sheet which is separated by the separating device, when the through holes intermittently communicate with a negative pressure in the vacuum chamber. The endless belt is driven it different speeds according to the rotational positions of the through holes, such that the rotational speed of the belt is increased until the belt reaches a position for attracting a next sheet after it has fed the uppermost sheet.

14 Claims, 10 Drawing Sheets

METHOD OF AND APPARATUS FOR SEPARATING AND FEEDING SHEETS

BACKGROUND OF THE INVENTION

The present invention relates separating sheets one by one from a pile of stacked sheets and feeding the thus separated sheets and more particularly, to a method and an apparatus suitable for use with equipment such as copying machines or printers in which a rapid and sure separation and feeding of the sheets is required.

In such equipment as a copying machine or a printer which contains a pile of sheets, it is required to pick or take out the sheets one by one from the pile of sheets and to convey the removed sheets to a predetermined position such as a printing section. A typical sheet feeding apparatus for this purpose has been disclosed in Japanese Patent Unexamined Publication No. 62-11184, and corresponding U.S. Pat. No. 4,678,176 where a vacuum-feeding device is arranged above the pile of sheets and a compressed air plenum chamber is provided adjacent to the pile of sheets.

In the sheet feeding apparatus disclosed in Japanese Patent Unexamined Publication No. 62-11184, the uppermost sheet of the piled sheets is floated up by air jet discharged from the compressed air plenum chamber, drawn or attracted and conveyed by the vacuum-feeding device. The vacuum-feeding device includes a vacuum chamber and an endless belt running around this vacuum chamber, and the endless belt is formed with a plurality of apertures for drawing the sheet through a negative pressure in the vacuum chamber. This publication also discloses an improved air knife which is provided for separating an upper portion of the sheet pile as a whole and includes horizontal air nozzles and other air nozzles for converging the air flow from the horizontal nozzles.

A sheet feeding apparatus of this type has also been disclosed in Japanese Patent Unexamined Publication Nos. 62-111844 and 62-111845, in each of which the conveying belt is divided into several sections with ribs interposed between these sections, and, a hopper on which the sheets are stacked is provided with claws for preventing more than two sheets from being taken out at once.

Further, Japanese Patent Unexamined Publication No. 62-93130 teaches taking-out of a sheet from the lowest portion of a sheet pile by using a vacuum-feeding apparatus which is similar to those disclosed in the above-mentioned publications.

Similarly, Japanese Patent Unexamined Publication No. 62-93141 discloses a feeding device which includes a vacuum chamber and a conveying belt cooperative with the vacuum chamber, and in which a sheet is drawn by the belt through a negative pressure in the vacuum chamber and conveyed by the belt. In this publication,it has been taught that the conveying belt is driven intermittently and formed with a plurality of through holes which are arranged over the length corresponding to one stroke of the intermittent drive motion.

It is desirous that various sheets can be surely separated and fed regardless of their types and thicknesses, because the sheets used in copying machines or printers have been diversified. It is also desired to decrease the time period required for the sheet separation and feeding for achieving more rapid operation of such an equipment as copying machine or printer.

Relating to the conveyance of sheets following to the taking-out thereof described in this application, the present inventors et al have filed U.S. application Ser. No. 395,015 titled as "METHOD AND APPARATUS FOR ADJUSTING POSTURE OF SHEET" on Aug. 17, 1989.

SUMMARY OF THE INVENTION

An object of the present invention is to provide a sheet separating and feeding apparatus which can surely separate a sheet from a pile of sheets and convey the same regardless of type and thickness of the sheet.

Another object of the present invention is to provide a method which makes it possible to separate a sheet from a pile of sheets and feed the same surely and rapidly.

For achieving the above-mentioned objects, in the present invention, air is caused to blow horizontally and upwardly towards an upper portion of the piled sheets, and a further air jet is introduced between the uppermost sheet and a subsequent sheet of the piled sheets. Consequently, the sheets in the upper portion of the pile are floated upwardly and are separated from one another, and the second sheet just below the uppermost sheet and following sheets are forced downwardly, thereby making it possible to surely separate the uppermost sheet. Further, regarding the sheet feeding action, the operation of sheet taking-out means until it begins to take out a next sheet after having taken out one sheet, or the operation having no influence on the taking-out of the sheets is speeded up, so that the time period required for the feeding of sheet can be reduced or the sheet taking-out means may stop once before the operation for picking the next sheet to surely take out the same.

According to the present invention, a sheet separating and feeding apparatus has a device for separating an uppermost sheet from piled sheets, and a device for vacuum-attracting the separated uppermost sheet to feed the same. This separating device includes main nozzle means and first auxiliary nozzle means causing air to blow horizontally and obliquely to an upper portion of the piled sheet from a lower side thereof, respectively, for floating and separating the sheets in the upper portion of the piled sheets from one another, and second auxiliary nozzle means introducing air jet between the uppermost sheet and the sheet just below the uppermost sheet for forcing the second and subsequent sheets downwards.

With this arrangement, the sheets at the upper portion of the pile are raised upwardly while being separated from one another. Further, the air jet from the second auxiliary nozzle means forces the second and subsequent sheets downwardly, thereby assuring the separation of the uppermost sheet. In case that a vacuum-feeding device comprises a conventional endless belt having a plurality of vacuum suction holes as described above, when the upper most sheet has been conveyed from the region of the pile, the air jet from the second auxiliary nozzle means is suctioned into the suction holes, so that the second and subsequent sheets, which have been being forced downwardly until then, can move upwardly to the surface of the vacuum-feeding device, thereby enabling a sure separation in a short period of time.

According to another feature of the invention, there is provided a method of separating an uppermost sheet from piled sheets by a separating device, vacuum-attracting the uppermost sheet by a movable feeding device for transferring the sheet to a conveying device, wherein the separating device causes compressed air to blow toward an upper portion of the piled sheets, and the vacuum-feeding device has a plurality of holes provided in a part of the device for communicating intermittently with a vacuum source. This method comprises the steps of locating the vacuum-feeding device at a position where leading ones of the holes relative to a feeding direction of the sheet are substantially aligned with the front edges of the piled sheets; operating the separating and vacuum-feeding devices to separate the uppermost sheet and draw the same to the vacuum-feeding device; moving the vacuum-feeding device on which the uppermost sheet has been attracted, at the substantially same speed as that of the conveying device; moving the vacuum-feeding device at a higher speed, after the sheet drawn by the vacuum-feeding device has reached the conveying device and communication between the holes and the vacuum source has been substantially ceased; and moving again the vacuum-feeding device at the substantially same speed as that of the conveying device, when the vacuum-feeding device comes at the above-mentioned position.

According to this method, the sheets are surely transferred to the conveying device by the vacuum-feeding device, and a period of time for the operation having no influence on the feeding of the sheets can be shortened, resulting in a rapid separation and feeding of the sheets. Further, the vacuum-feeding device may stop at the above-mentioned position every cycle of operation by utilizing the spare time which is provided by the shortened operation. In this case, since the motion of the feeding device is stopped, the sheet can be surely drawn or attracted, and since the sheet is securely attracted with the front edge thereof aligned with the leading holes of the vacuum-feeding device, the compressed air flow from the separating device can be strengthened for performing the separation of the uppermost sheet more surely.

BRIEF DESCRIPTION OF THE DRAWINGS

The above-described and other objects, features and advantages will become clear from the description and the appended claims, which description will be made below with reference to the accompanying drawings. All the drawings show embodiments of the present invention, wherein:

DETAILED DESCRIPTION OF THE PREFERRED EMBODIMENTS

Figure 1:
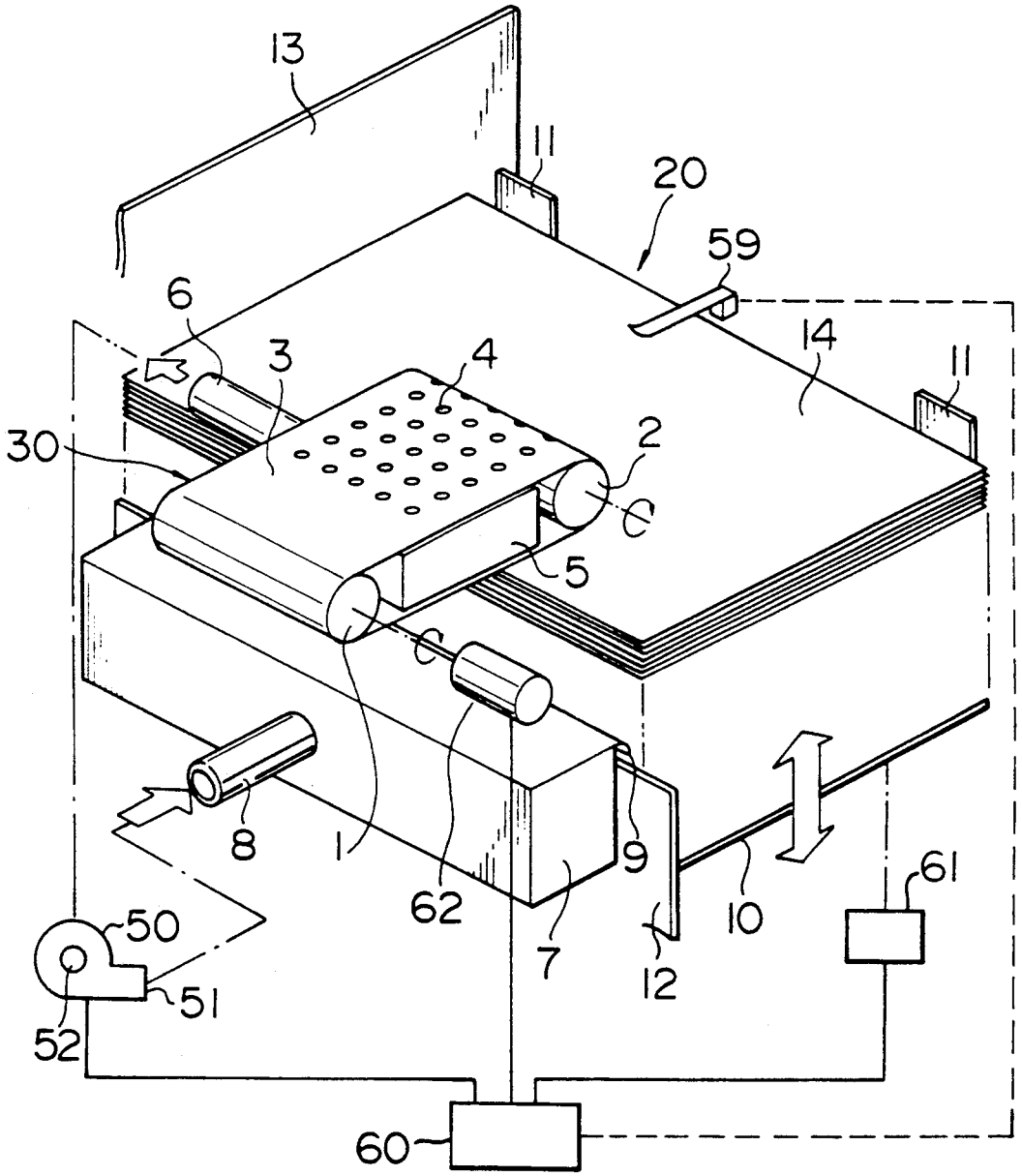
FIG. 1 is a schematic perspective view of a sheet separating and feeding apparatus according to a first embodiment of the invention.
Figure 2:
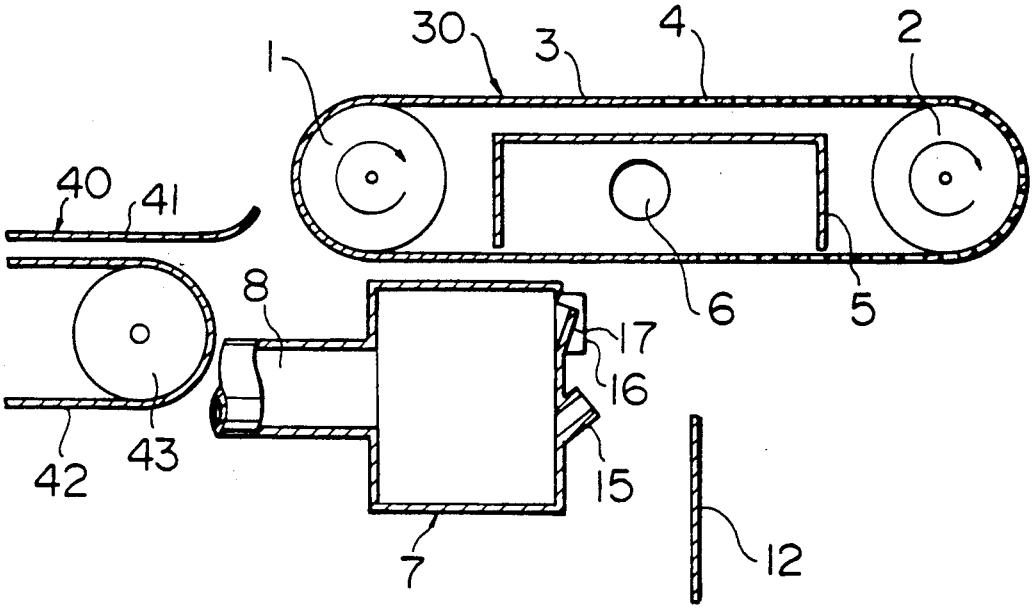
FIG. 2 is a sectional view of a portion of the apparatus shown in FIG. 1.
Figure 3:
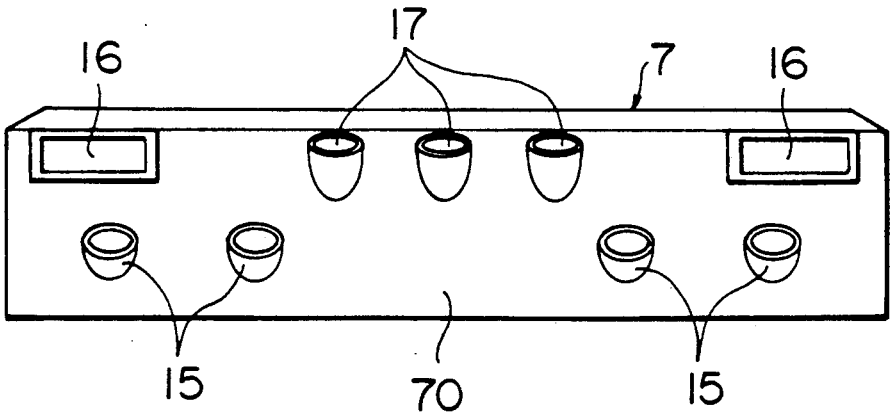
FIG. 3 is a front view of a compressed air chamber used in the device shown in FIG. 1.

Referring to FIGS. 1 to 3, the sheet separating and feeding apparatus according to the first embodiment of the invention includes a hopper generally designated by the reference number 20 for accommodating sheets, and a vacuum-feeding device generally designated by the reference number 30 and a compressed air plenum chamber 7 both of which are located adjacent to the hopper 20.

The hopper 20 includes an elevator 10 on which a plurality of sheets 14 are piled up. The elevator 10 is disposed between a pair of side plates 13, only one of which is illustrated in the drawings. A first motor 61, serving as a driving source, is connected with the elevator 10 to drive the same upwardly and downwardly along the side plates 13. The separating and feeding apparatus further includes a central processing unit 60 and a sensor 59 for detecting the position of the uppermost surface of the piled sheets 14. The central processing unit 60 is adapted to output signals for controlling the start or stop of the first motor 61, when it receives signals from the sensor 59. By this arrangement, the elevator 10 is so operated as to locate the upper end of the sheets 14 at a constant height.

The rear edges of the sheets 14 piled in the hopper 20 are trued up by a rear end guide plate 11, while the front edges of the same are trued up by a front end guide plate 12.

The compressed air plenum chamber 7 is disposed opposite to the front edges of the sheets 14. On a side of this compressed air plenum chamber 7 facing the sheets 14, there are provided, as shown in FIG. 2, main nozzles 16, first auxiliary nozzles 15, and second auxiliary nozzles 17 for releasing compressed air to separate an upper portion of the piled sheets 14. The compressed air plenum chamber 7 is connected with an exhaust port 51 of a air supply source 51 such as a blower through a blast pipe 8 for supply of air. This air supply source 51 is operative under the control of central processing unit 60.

The vacuum-feeding device 30 is provided for drawing or attracting the uppermost one of the sheets piled in the hopper 20 and for feeding the same. This device 30 includes, as shown in FIG. 2, an endless separating belt 3 which is wound around a drive roller 1 and a follower roller 2 to extend substantially in parallel with the sheets 14. The separating belt 303 is formed at a part thereof with a plurality of suction holes 4, and a vacuum chamber 5 is disposed within the wound belt 3. The vacuum chamber 5 has an opening provided on the lower side thereof, and is connected with a suction port 52 of the air supply source 50 through a discharge pipe 6, thereby attracting the sheet 14 by a negative pressure through the holes 4 of the endless belt 3.

Although, in this embodiment, the air supply source is used to suck suction air in the vacuum chamber 5 and to deliver the sucked suctioned air to the compressed air plenum chamber 7, separate devices such as blowers may be provided for the vacuum chamber and the compressed air plenum chamber.

Referring to FIG. 3, the main nozzles 16 are respectively located at both upper side ends of the compressed air plenum chamber 7 to cause air to blow horizontally toward the upper portion of the sheets 14 piled in the hopper. The first auxiliary nozzles 15 are arranged along the length of the chamber 7 in heightwise central portions thereof to cause air to blow toward the upper portion of the piled sheets 14 from the lower side thereof. The second nozzles 17 are arranged between the main nozzles 16 in upper central portions of the plenum chamber 7, and cause air to blow toward a lower surface of the separating belt 3. The number, cross-sectional areas and shapes of these air nozzles are determined in consideration of the pressure of air to be jetted.

The plurality of suction holes 4 of the endless belt 3 are arrayed in a transverse direction of the belt 3, and plural rows of the suction holes 4 are arranged substantially over a half of the peripheral length of the endless belt 3. The drive roller 1 is connected to a second motor 62 which is rotated or stopped under the control of the central processing unit 60. The above-described component parts are secured directly or indirectly to the side walls 13 or a bottom plate (not shown) of the separating and feeding apparatus. At the downstream side of the vacuum-feeding device 30, there is arranged a conveying device 40 which comprises, as shown in FIG. 2, a guide plate 41, a roller 43, and plural conveyor belts 42 running around roller 43 to convey the sheets separated by the vacuum-feeding device 30.

Figure 4:
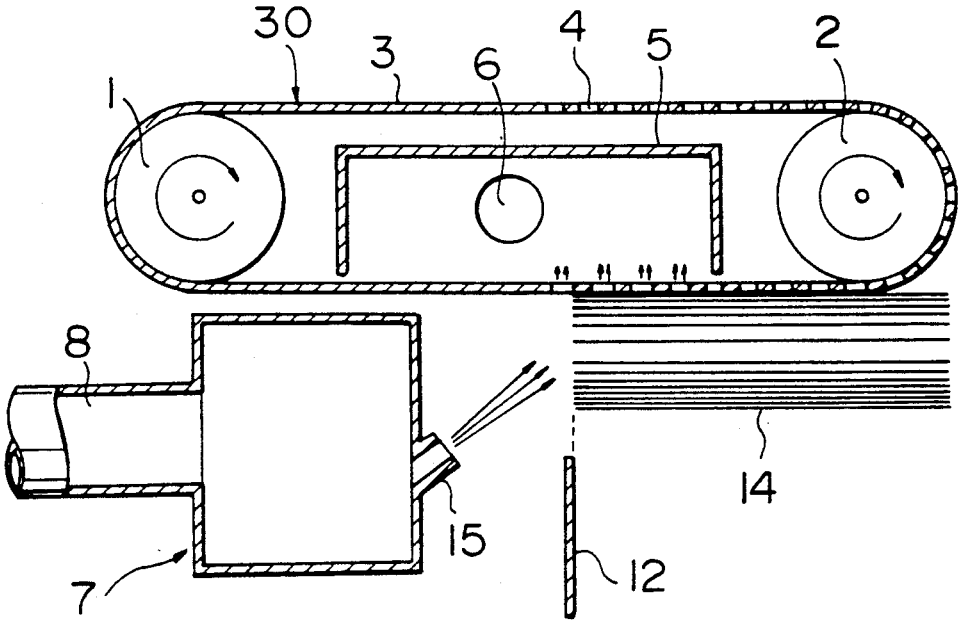
FIGS. 4 to 6 are cross-sectional view for explaining the function of the compressed air chamber used in the apparatus shown in FIG. 1.

FIG. 4 shows the function of the first auxiliary air nozzles 15. When air jets are discharged through the upwardly directed first auxiliary nozzles 15 toward the upper portion of the sheets 14 piled in the hopper, several sheets in the upper portion of the pile are raised onto the separating belt 3, thereby making a wide gap between the raised sheets and the remainder of the piled sheets. Thus, a part of the piled sheets is separated from the other.

Figure 5:
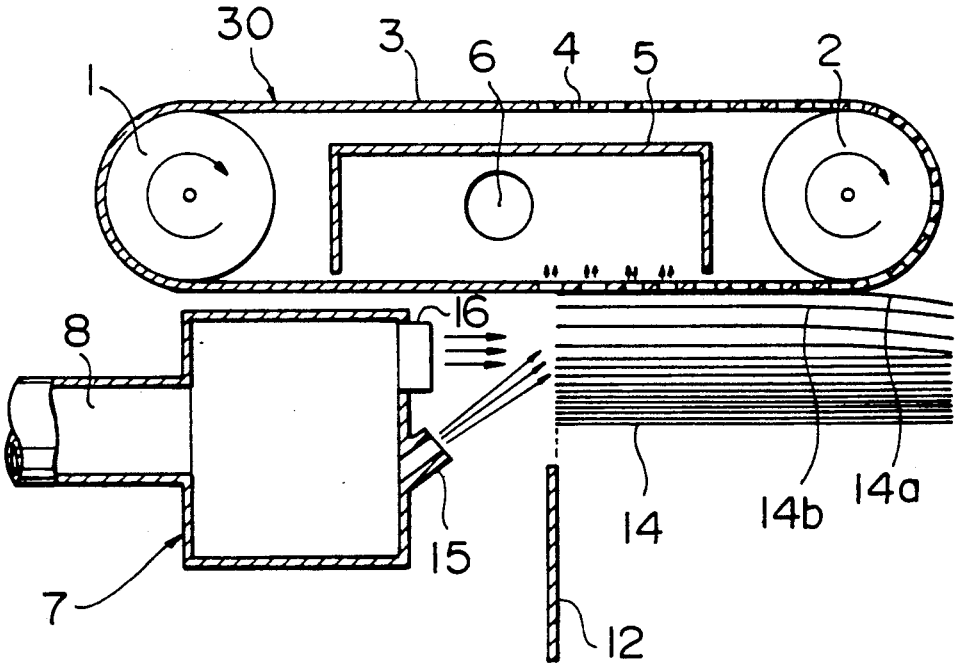

FIG. 5 shows the function of the main nozzles 16, in addition to that of the first auxiliary nozzles 15. The several sheets 14 which have been raised onto the separating belt 3 by the air jets from the first auxiliary nozzles 15 are further separated from one another by the air jets from main nozzles 16, thereby forming a narrow gap between adjacent sheets. Further, the air jets from the main nozzles 16 force the piled sheets backward, namely, in a direction opposite to that of feeding of the sheets. Consequently, when the vacuum-feeding device 30 is in operation, the uppermost sheet **14*a* is attracted to the separating belt 3 through the suction holes 4, and a narrow gap is formed between the uppermost sheet 14*a* and the sheet just below the uppermost sheet or the second sheet 14*b***. The amount of this gap varies in dependence upon vibration of the sheets or type of the sheet, and some portions of these two sheets possibly contact with each other.

Figure 6:
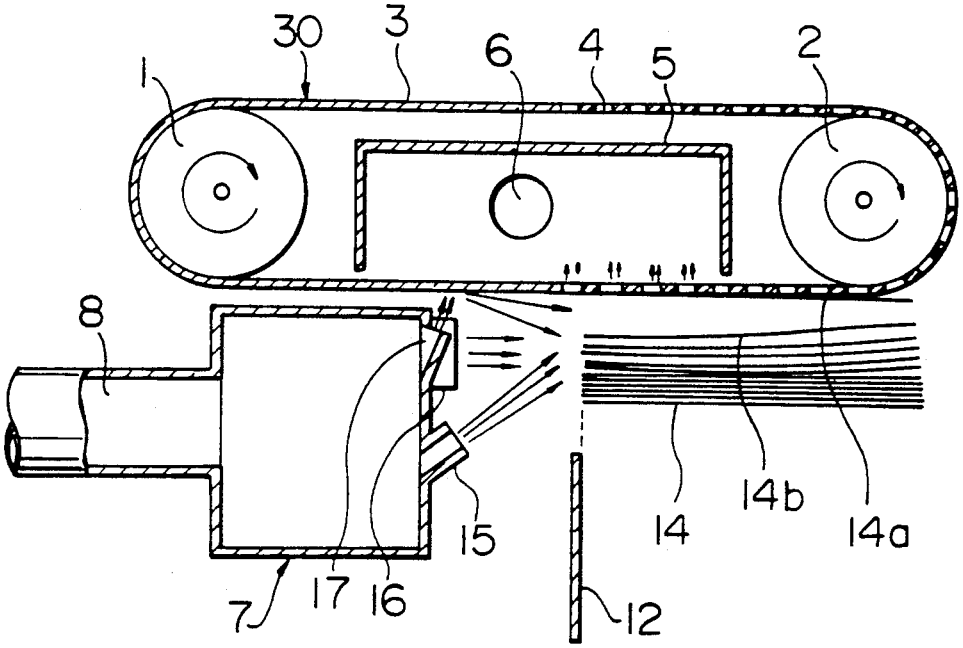

FIG. 6 shows the function of the upwardly directed second auxiliary nozzles 17 in addition to those of the first auxiliary nozzles 15 and the main nozzles 16.

Figure 7:
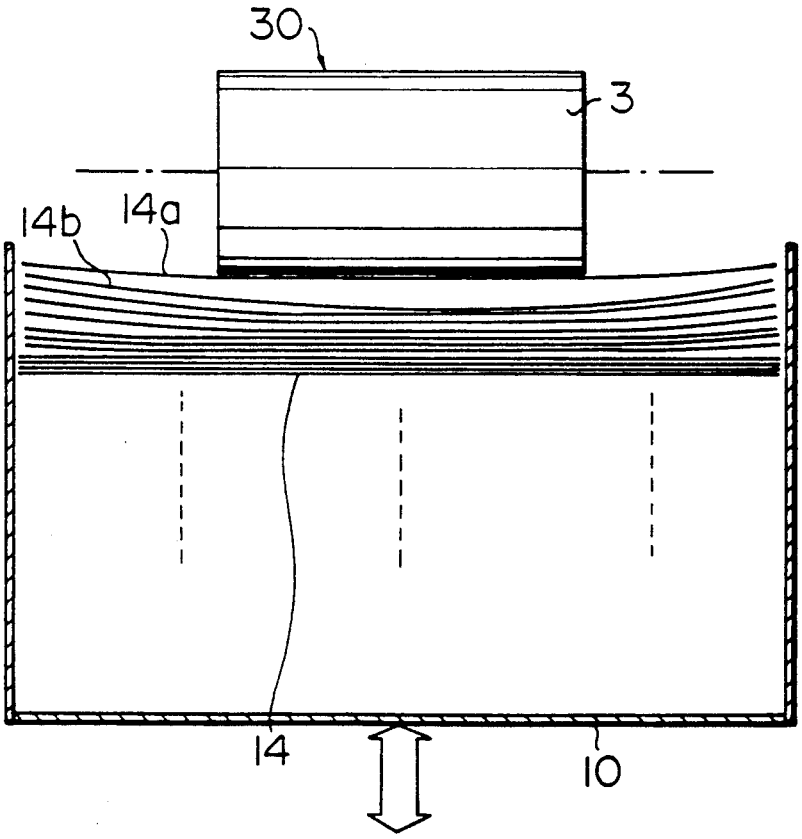
FIG. 7 shows the condition of the piled sheets shown in FIG. 6 as viewed from the compressed air chamber side.
Figure 8:
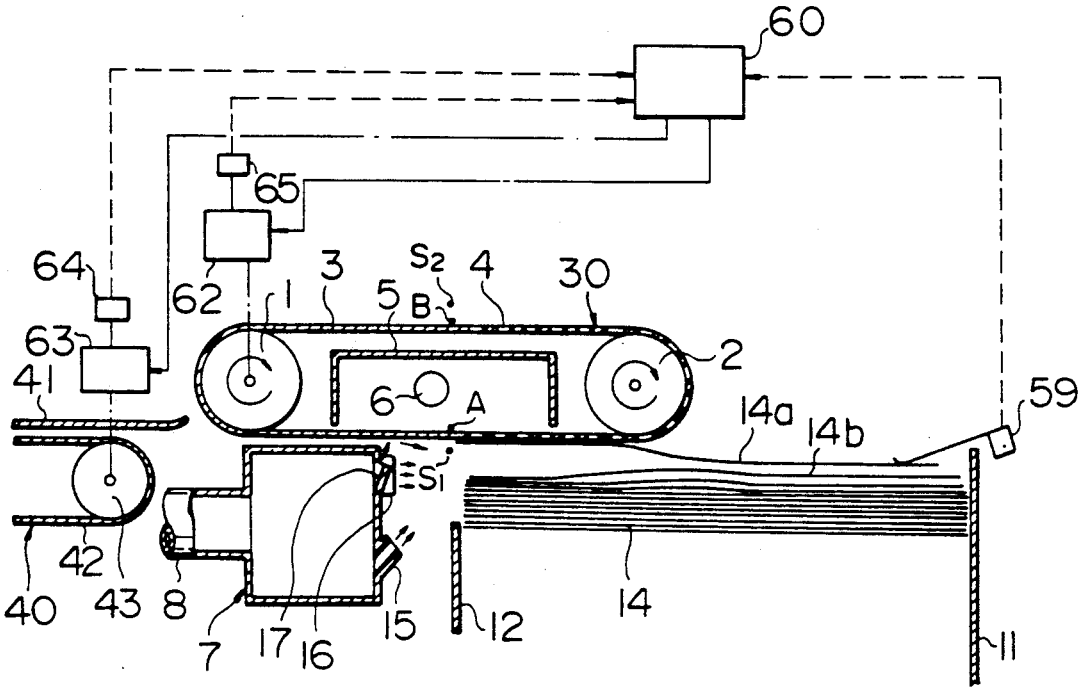
FIG. 8 is a sectional view showing a separating and feeding apparatus according to another embodiment of the invention.

The air jet from the second auxiliary nozzles 17 functions to widen the gap between the uppermost sheet **14*a* and the second sheet 14*b*. That is, the air jets from the second auxiliary nozzles 17 first collide against the separating belt 3 at a portion thereof where no suction hole 4 exists, and then flowback in directions as indicated by arrows in the drawing. These back flowed air jets force the second and subsequent sheets downwardly and rearwardly. As a result, a wide gap is formed between the sheet 14*a* and the sheet 14*b*, and the separated sheets including the sheet 14*b* and the sheets below the sheet 14*b* are forced against the rear guide plate 11. FIG. 7 shows the state of the wide gap formed between the sheet 14*a* and the sheet 14*b* a viewed from the compressed air plenum chamber 7**.

The separating and feeding operations of the sheet separating and feeding apparatus according to the first embodiment of the invention shown in FIGS. 1 to 7 will now be described.

First, the sheets 14 are mounted on the elevator 10 of the hopper 20.

Next, the first motor 61 is started in response to a starting trigger signal from the central processing unit 60 to move the elevator 10 upwardly. In the upward motion of the elevator, when the uppermost one of the sheets piled on the elevator 10 is detected by the upper end detecting sensor 59, the first motor 61 stopped to stop the elevator 10. The sensor 59 is always detects the height of the sheets 14 during the operation of the separating and feeding apparatus, and the elevator 10 is driven so as to always keep the position of the upper end of the piled sheets at a predetermined level even when the sheets are being separated successively.

In this condition, in response to a starting signal from the central processing unit 60, the air supply source 50 starts operating, and the second motor 62 also starts to drive the separating belt 3. As a result, air jets are discharged from the main nozzles 16, first auxiliary nozzles 15, and second nozzles 17 toward the upper portion of the sheets piled in the hopper 20, as shown in FIGS. 4 to 6.

At the same time, the air in the vacuum chamber 5 of the vacuum-feeding device 30 is exhausted.

By virtue of the functions of the compressed air plenum chamber 7 and the vacuum-feeding device 30, the uppermost sheet **14*a* of the sheets piled in the hopper 20 is drawn or attracted onto the separating belt 3, and is conveyed from the hopper 20 as the separating belt 3 runs round. The sheet 14*a* thus taken out is released from the separating belt 3 as the suction holes 4 thereof become out of the region of the vacuum chamber 5, so as to be conveyed by the conveying device 40 which is arranged downstream of the vacuum-feeding device 30. In this taking-out operation of the sheet 14, since the air jets from the second auxiliary nozzles 17 function to sufficiently widen the gap between the uppermost sheet 14*a* and the second sheet 14*b* and to force downwardly and rearwardly the second and subsequent sheets, the second sheet 14*b* is not carried out together with the uppermost sheet 14*a*. Thus, when the sheet 14*a* is passing over the second auxiliary nozzles 17, the above-mentioned downwardly directed force acts on the remainder of the piled sheets at all times, thereby preventing any contact between the sheet 14*a* and the sheet 14*b* and assuring a stable separation. When the separating belt 3 has run one round, the effect of the air jets from the upwardly directed nozzles 17 becomes ineffective due to the suctioning action through the suction holes 4 in the belt 3, and the second sheet 14*b* is attracted onto the separating belt 3. The time period required for attracting the second sheet 14*b* onto the separating belt 3 is significantly decreased by the suction effect through the suction holes 4** and by the restitution of the sheets owing to the elimination of the downward force action thereon, thereby enabling a rapid and stable separation of the sheets.

FIGS. 8 to 12 show the sheet separating and feeding apparatus according to a second embodiment of the invention, the component parts of the apparatus identical with or having similar function such those of the first embodiment will be denoted by the same reference numerals, and detailed description of such component parts will be omitted.

In the embodiment of FIGS. 8–12, the apparatus is so constructed that the moving speed of the separating belt 3 of the vacuum-feeding device 30 when the portion of the belt 3 having no suction holes is passing over the nozzles of the compressed air plenum chamber 7 is faster than that of the conveying device 40, and the separating belt 3 is then stopped for a short period of time when the next sheet is to be separated and attracted. As a result, the separating belt 3 can securely attract the next sheet when the separation thereof has been completed, thereby performing a rapid and stable separation of the sheet 10. To this end, this embodiment includes encoders 64, 65 for detecting the speeds of the conveying device 40 and the separating belt 3. The structure of the apparatus according to the second embodiment is identical with that of the first embodiment except for the above.

In the embodiment of FIGS. 8–12, the stop position of the separating belt 3 when the apparatus begins to operate is so set that the leading end A of the belt portion where the suction holes 4 are formed lies at a predetermined position $S_1$ and the trailing end B of that belt portion lies at a predetermined position $S_2$. Stopping the separating belt 3 at this stop position may be set, for example, by arranging means for detecting the existence of the suction holes 4 at the positions $S_1$ and $S_2$, and driving the separating belt 3 through the central processing unit 60 based on signals from these detecting means. The length of the belt portion having the suction holes 4 is set to be equal to or longer than the length which is required for transferring one sheet 14 to the conveying device 40.

The conveying speed of the conveying device 40 is detected by the first encoder 64 which is connected to a third motor 63 for driving the conveyor belts 42, and also the speed of the separating belt 3 is detected by the second encoder 65 which is connected to a second motor 62 for driving the belt. Signals from these encoders are fed to the central processing unit 60.

At a starting of the operation of the separating and feeding apparatus, the separating belt 3 lies at the above-described stop position, and the upper end of the piled sheets 14 is leveled at a predetermined height by means of the detector 59. In this state, air is caused to blow through the main nozzles 16 and auxiliary nozzles 15, 17 provided on the compressed air plenum chamber 7, and the air in the vacuum chamber 5 is exhausted, so that the uppermost sheet 14 of the pile is separated and attracted onto the separating belt 3.

Subsequently, upon receiving a start trigger signal from the central processing unit 60, the second motor is started and the separating belt 3 starts rotating in the separating and feeding direction. The steady speed of the separating belt 3 after acceleration becomes substantially equal to the conveying speed $V_1$ of the conveying device 40 which is arranged downstream of the separating apparatus.

Figure 9:
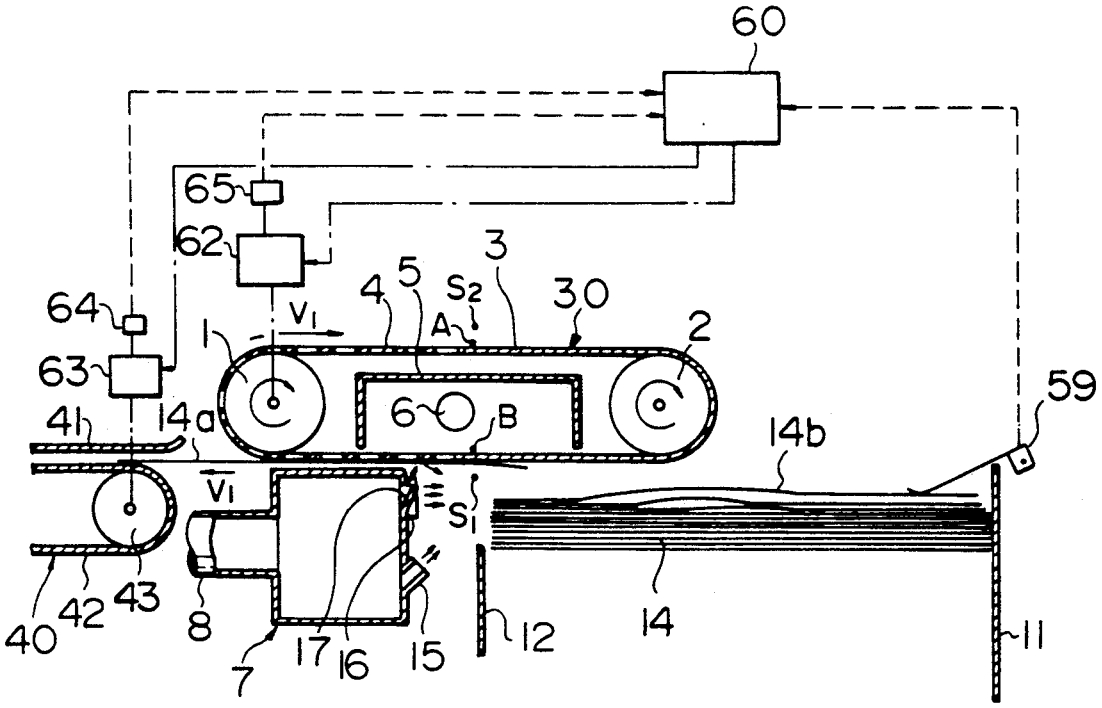
FIGS. 9 to 11 are cross-sectional views for explaining the function of the apparatus shown in FIG. 8.
Figure 10:
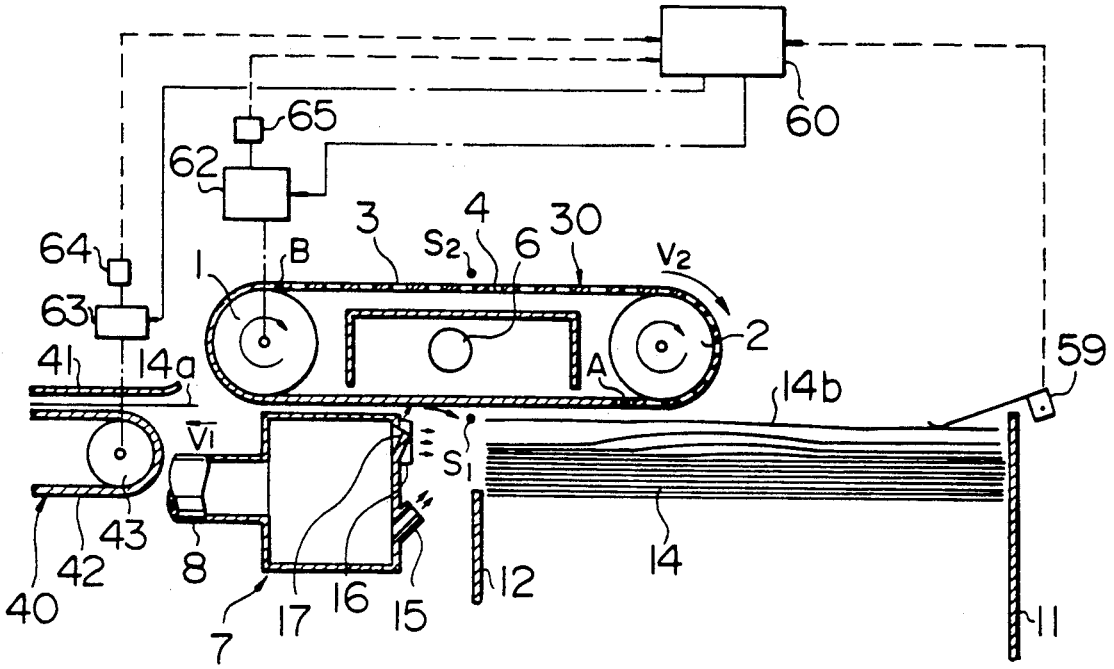

As shown in FIG. 9, when the trailing end B of the suction holes 4 is passing over the vacuum chamber 5, a drawing force on the sheet 14 through the suction holes 4 becomes diminished. Further, since the friction between the belt portion having no suction hole 4 and the sheet 14 is small, there arises no particular problem in the conveying operation even if a relatively sliding motion is caused therebetween.

In view of the above, when the trailing end B of the suction holes 4 has passed over the vacuum chamber 5, the speed of the separating belt 3 is increased to a speed $V_2$ which is faster than the sheet conveying speed $V_1$ of the conveying device 40, thereby making it possible for the leading end A to reach the above described position $S_1$ in a shorter time. However, the operation is so controlled that the leading end A of the belt portion having the suction holes 4 does not pass the position $S_1$ before the rear end of the uppermost sheet 14*a* has passed over the position $S_1$.

Figure 11:
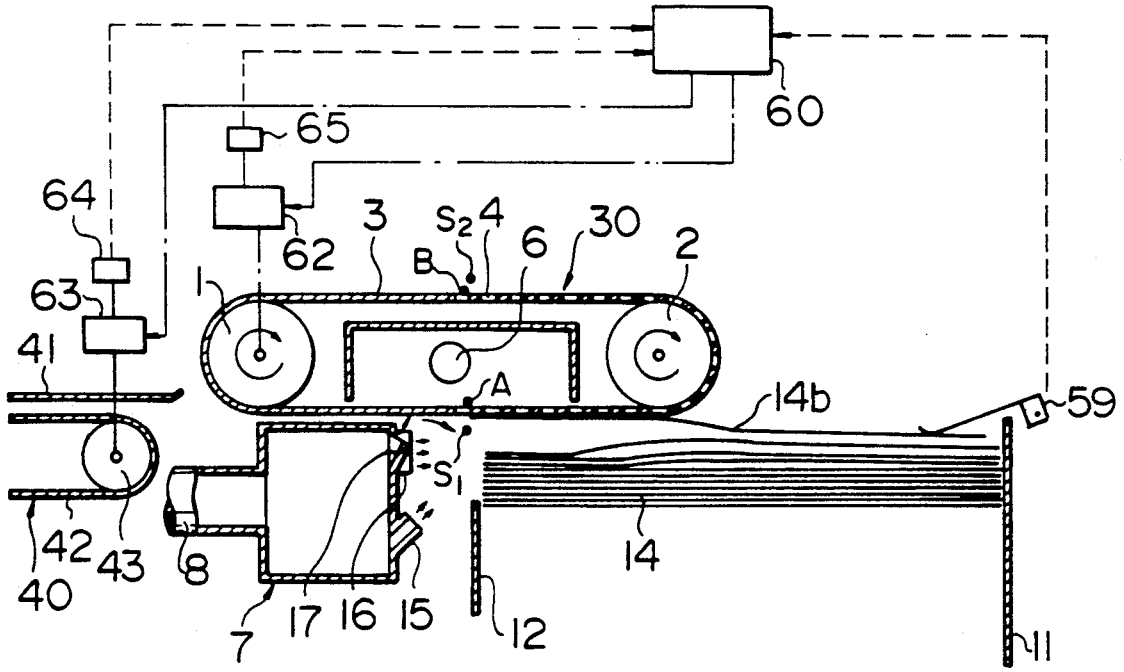

As shown in FIG. 11, when the leading end A of the suction holes 4 reaches the position $S_1$, the separating belt 3 is stopped, and during this stopping period, the second sheet 14*b* is drawn onto the belt through the suction holes 4. These speed controls are carried out by the central processing unit 60 on the basis of the speed signals from the first encoder 64 and second encoder 65.

Figure 12:
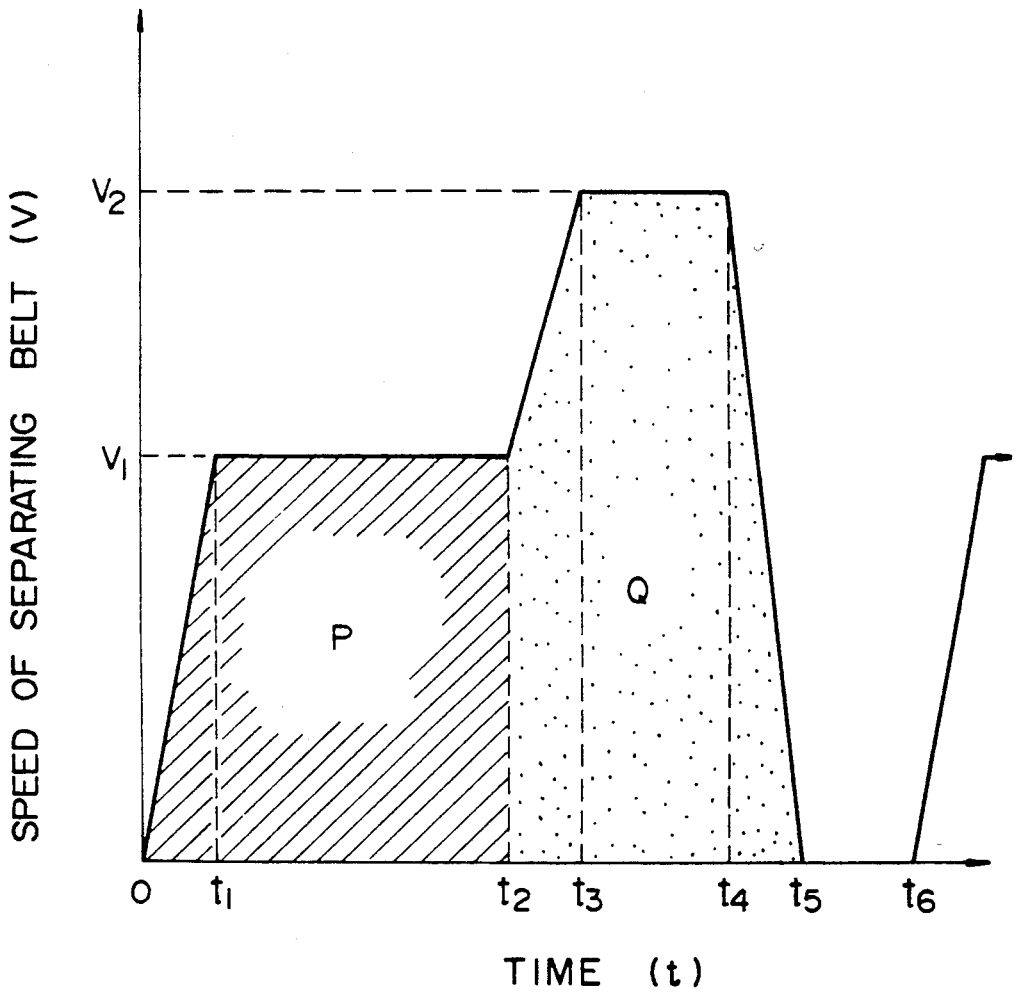
FIG. 12 is a diagrammatic illustration of a rotation speed pattern of the separation belt in the apparatus shown in FIG. 8.
Figure 13:
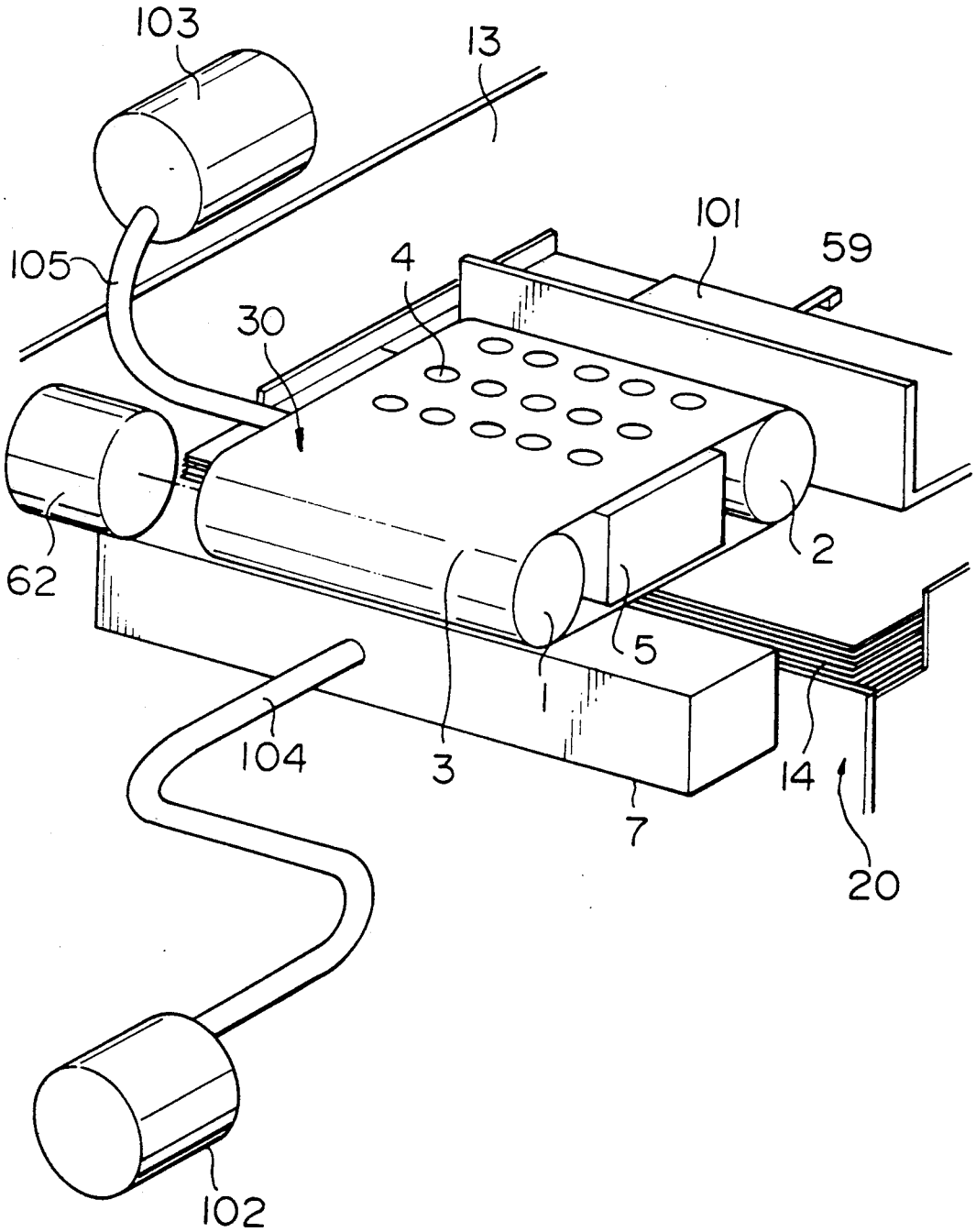
FIG. 13 is a perspective view of a sheet separating and feeding apparatus according to still another embodiment of the invention.

The control sequence carried out by the central processing unit 60 will be described below, with reference to FIG. 12, in terms of a relation between the speed of the separating belt 3 and elapsed time. In FIG. 12, the axis of ordinates represents belt speed v and the axis of abscissas represent time t.

From FIG. 12, it will be understood that the separating action of the sheet 14 is carried out every period of time $t_6$. Until time $t_1$, the separating belt 3 is accelerated to speed $v_1$, and the belt is moved at the constant speed $v_1$ until time $t_2$. The separating belt 3 moves until time $t_2$ over the distance which corresponds to the area indicated with hatch lines in the drawing, namely, the distance from the point A to the point B of the separating belt 3.

When the attracting force of the separating belt 3 for the sheet 14 has almost disappeared, the separating belt 3 is accelerated to a speed $v_2$ by time $t_3$. then, the separating belt 3 is driven to be decelerated from time $t_4$ so that the area dotted in the drawing corresponds to the length of the belt portion having no suction hole 4 and the belt 3 stops at time $t_5$.

From time $t_5$ to time $t_6$, the separating belt 3 is maintained in a stopped condition, and during this period of time, the separating belt attracts the next sheet 14, in preparation for another run starting at time $t_6$.

By repeating the above-described operational sequence, a sufficient period of time $t_6$–$t_5$ can be spared for picking up and holding the sheet, and at the same time a rapid separation of the next sheet 14 can be carried out.

According to this the embodiment of FIGS. 8–12, since a sufficient time for attracting and holding the sheet can be provided even if the period of the sheet separating cycle is made shorter, a highly reliable separation of the sheet at a high speed, can be achieved.

The apparatus according to the embodiment of FIGS. 13–19 has a similar structure to that of the embodiment of FIGS. 1–7, which includes such component parts of the hopper 20, the compressed air plenum chamber 7, the vacuum-feeding device 30 and the central processing unit (not shown), and further comprises a guide 101 provided above the hopper 20 and, instead of the commonly used air supply source, an air exhausting device 103 and an air supply source 102 such as blowers which are separately provided for the vacuum-feeding device 30 and the compressed air plenum chamber 7, respectively. The guide 101 is provided for preventing the sheets 14 from excessively floating up to enhance the separation effect. The exhausting device 103 is connected to the vacuum chamber 5 through an exhaust pipe 105, while the air supply device 102 is connected to the compressed air plenum chamber 7 through an air supply pipe 104. Although, in FIG. 13, the second motor 62 for driving the separating belt 3 is disposed in the opposite side of the separating belt 3 to that in FIG. 1, it has the same function and drives the separating belt in the same direction as is in the preceding embodiments.

The separating belt 3 of the vacuum-feeding device 30 is controlled to run one round every feeding of one sheet 14 as is in the embodiment of FIGS. 8–12, and, when stopped to lie always at a position where a constant positional relationship is established between the suction holes 4 and the sheets 14. This positional relationship is, however, somewhat different from that in the embodiment of FIGS. 8–12, and will be described below as well as the control process of the operating with reference to FIGS. 14 to 19.

Figure 14:
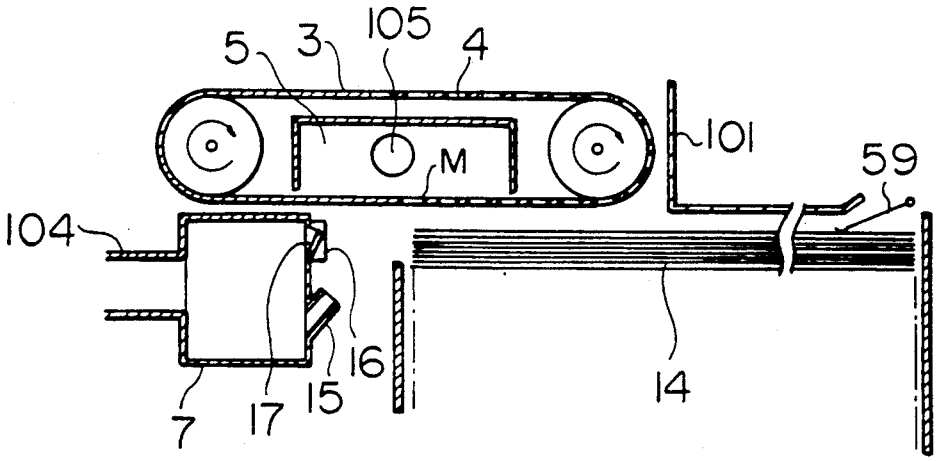
FIGS. 14 to 19 are cross-sectional views for explaining the function of the apparatus shown in FIG. 13.

FIG. 14 shows the sheet separating and feeding apparatus in the initial state thereof before operation. In this state, the upper end of the piled sheets 14 has been leveled at a predetermined height by the detection of the sensor 59. And, the separating belt 3 is so positioned that the leading portions of the suction holes 4 provided over a substantially half of the peripheral length of the belt lie at a position M which is somewhat rearward, with respect to the direction of feeding of the sheet, of the front edges of the sheets on the hopper 20.

FIGS. 15 to 19 show the progress of separating one sheet 14 and feeding the same to the conveying device arranged downstream of the separating and feeding apparatus. In the stage shown in FIG. 15, the vacuum-feeding device 30 and the compressed air plenum chamber 7 are in operation under the control of the central processing unit 60, and an upper portion of the piled sheets 14 is separated due to the air jets discharged through the various nozzles of the compressed air plenum chamber 7. When the uppermost sheet 14 has been separated and floated up, it is attracted onto the separating belt 3 through the suction holes 4 by the negative pressure in the vacuum chamber 5. At this time, since the uppermost sheet 14 is in close contact with the separating belt 3 with the front edge F of the sheet drawn by the suction holes 4 of the leading row at the position M, it suffers no influence from the upward air jets of the auxiliary nozzles 17. On the other hand, the second and subsequent sheets are separated from the uppermost sheet and pushed rearwardly and downwardly by the air jets from the nozzles 17, as explained in connection with the embodiment of FIGS. 1–7.

Figure 16:
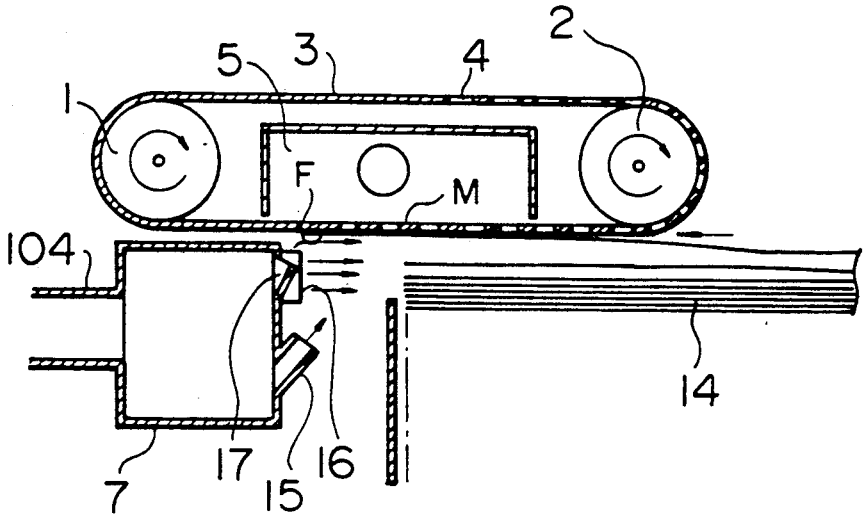

FIG. 16 shows the state of the separating and feeding apparatus just after the separating belt 3 begins being driven. Although, as the separating belt 3 moves, the pressure of air jets from the auxiliary nozzles 17 acting on the attracted sheet 14 increases, there occurs no relative slip between the sheet and the separating belt 3, because the front edge F of the sheet is securely attracted by the suction holes 4.

Figure 15:
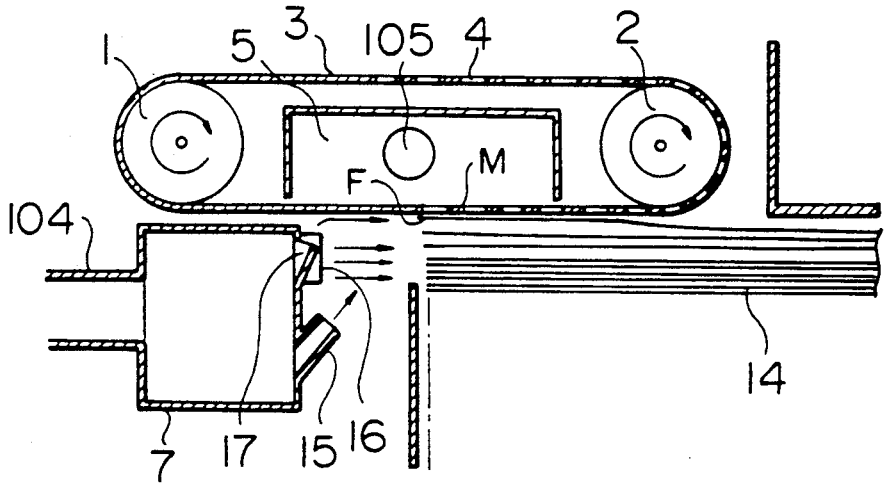

In the stages shown in FIGS. 15 and 16, a part of the air jets from the upwardly directed auxiliary nozzles 17 may come into between the belt portions between adjacent suction holes 4 and the sheet 14. Consequently, the air flow passing between the sheet 14 attracted onto the separating belt 3 and the following sheet becomes relatively small and therefore, the gap between them is also relatively small.

Figure 17:
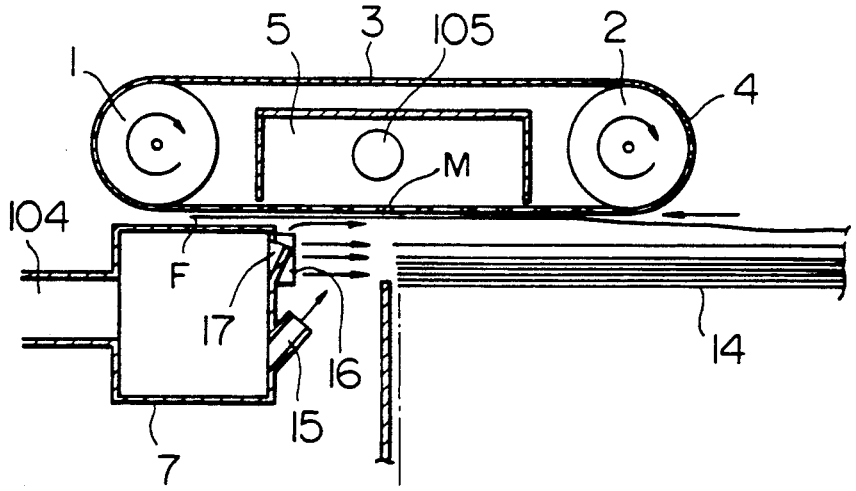
Figure 18:
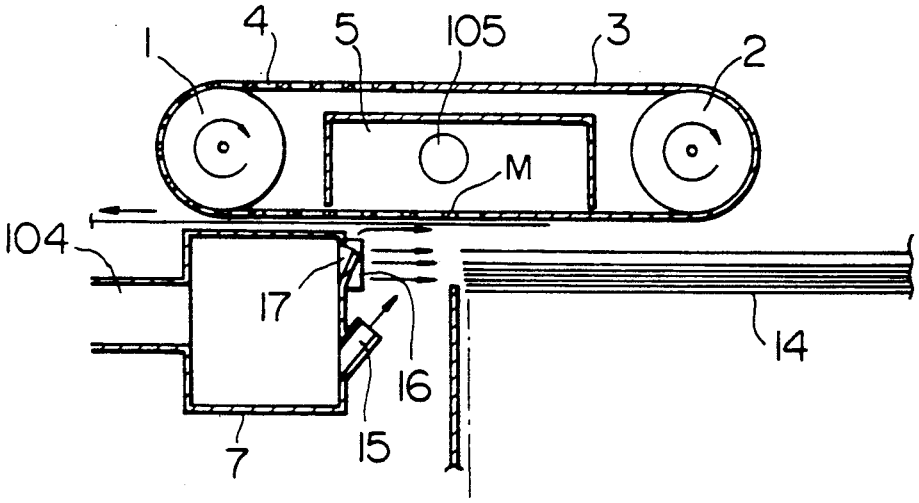

On the other hand, when the sheet 14 has been transferred into the state shown in FIG. 17, the abovedescribed air flow entering into the belt portions between adjacent suction holes 4 is decreased, and the amount of the air flow passing between the sheet 14 attracted to the separating belt 3 and the second sheet is increased, thereby making the gap between these two sheets wider and effecting a good separation of the sheet. This good separation condition is maintained also in the stage shown in FIG. 18, where the uppermost sheet has completely taken out from the hopper 20.

Figure 19:
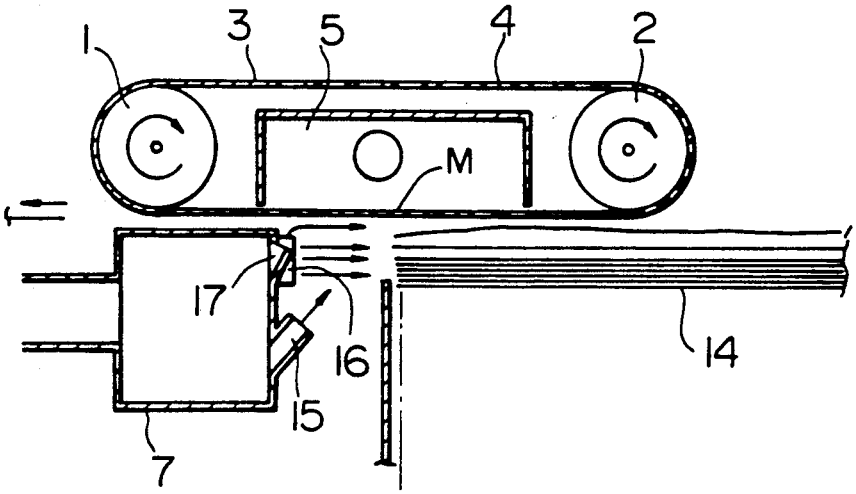

FIG. 19 shows the state wherein the separating belt has been further driven and the leading portions of the suction holes 4 have again reached a position above the sheets 14 on the hopper 20. When some of the suction holes 4 come into the region of the vacuum chamber 5, another uppermost sheet 14 is raised up due to the negative pressure in the vacuum chamber 5. However, until the front edge of this sheet 14 is attracted onto the separating belt 3, there is a slip between the sheet and the belt, because the air jets from the compressed air plenum chamber 7 are flowing between the separating belt 3 and the sheet 14. Namely, the sheet 14 continues to remain in the hopper 20. When, with a further rotation of the separating belt 3, the leading portions of the suction holes 4 have reached the position M at last, the separating belt 3 is stopped under the control of the central processing unit 60. In this state, the suction holes 4 of the leading row attract the front edge of the sheet 14.

By repeating the above-described operation, the sheets are separated and fed one by one from the hopper. According to this embodiment, since a wide air gap is made between the sheet to be taken out and the following sheet and the former sheet is securely attracted onto the separating belt 3, it is possible to separate the sheets with a high reliability even in case of thick sheets.

Although the present invention has been described with reference to the specific embodiments, it should be understood that the invention is not limited solely to the specific forms of these embodiments, and various changes and modifications may be made or the invention may take other forms without departing from the scope of the appended claims.

What is claimed is:

1. A sheet separating and feeding apparatus comprising: means for separating an uppermost sheet from piled sheets; means for vacuum-attracting and feeding said separated uppermost sheets; said separating means including a compressed air plenum chamber disposed in front of the piled sheets, main nozzle means and first auxiliary nozzle means for causing air to blow the sheets in an upper portion of the piled sheets horizontally and obliquely from a lower side thereof, respectively, to float up the sheets in the upper portion of said piled sheets and separate the same from one another, and second auxiliary nozzle means for introducing an air jet between said uppermost sheet attracted onto said vacuum-attracting and feeding means and a second sheet just below the uppermost sheet to force the second and subsequent sheets downwardly, said second auxiliary nozzle means is arranged over a region which corresponds to a width of said vacuum-attracting and feeding means in a direction transverse to a sheet feeding direction and causes air to blow to said vacuum-attracting and feeding means so that the air jet first collides against said vacuum-attracting and feeding means and flows rearwardly toward the second and subsequent sheets, said main nozzle means, first auxiliary nozzle means and second auxiliary nozzle means respectively comprises a pair of main nozzles, at least one first auxiliary nozzle and at least one second auxiliary nozzle which are provided on an opposing side of said compressed air plenum chamber to said sheets, said main nozzles being arranged at opposite upper ends of said compressed air plenum chamber, said first auxiliary nozzle being arranged at a mid-height portion of said plenum chamber, said second auxiliary nozzle being arranged at an upper central portion of said plenum chamber, said vacuum-attracting and feeding means include a vacuum chamber located above the piled sheets and an endless belt rotating around said vacuum chamber substantially in parallel to the uppermost sheet, said belt being formed with a plurality of through holes for communicating with said vacuum chamber to draw the uppermost sheet by a negative pressure into said vacuum chamber, said through holes are formed in a part of said endless belt at regular intervals along the sheet feeding direction, and wherein said second auxiliary nozzle means discharges the air jet toward said vacuum-attracting and feeding means in such a manner that the air jet first collide against said belt and then flows rearwardly toward the second and subsequent sheets.

2. A sheet separating and feeding apparatus comprising: means for separating an uppermost sheet from piled sheets; means for vacuum-attracting and feeding said separated uppermost sheet; said separating means including main nozzle means and first auxiliary nozzle means for causing air to blow two sheets in an upper portion of the piled sheets horizontally and obliquely from a lower side thereof, respectively, to float up the sheets in the upper portion of said piled sheets and separating the same from one another, and second auxiliary nozzle means for introducing air jet between said uppermost sheet attracted onto said vacuum-attracting and feeding means and a second sheet just below the uppermost sheet to force downwards the second and subsequent sheets, and wherein said separating means includes a compressed air plenum chamber disposed in front of the piled sheets with respect to a direction of the feeding of the sheets, and said main nozzle means, first auxiliary nozzle means and second auxiliary nozzle means comprise respectively a pair of main nozzles, at least one first auxiliary nozzle and at least one second auxiliary nozzle which are provided on an opposing side of said compressed air plenum chamber to said sheets, said main nozzles being arranged at opposite upper ends of said compressed air plenum chamber, said first auxiliary nozzle being arranged at a heightwise middle portion of said plenum chamber, said second auxiliary nozzle being arranged on an upper central portion of said plenum chamber.

3. A separating and feeding apparatus comprising: means for separating an uppermost sheet from piled sheets; means for vacuum-attracting and feeding said separated uppermost sheet; said separating means including main nozzle means and first auxiliary nozzle means for causing air to blow toward the sheets in an upper portion of the piled sheets horizontally and obliquely from a lower side thereof, respectively, to float the sheets upwardly in the upper portion of said piled sheets and separate the same from one another, and second auxiliary nozzle means for introducing an air jet between said uppermost sheet attracted onto said vacuum-attracting and feeding means and a second sheet just below the uppermost sheet to force the second and subsequent sheets downwardly, said vacuum-feeding means include a vacuum chamber located above the piled sheets and an endless belt rotating around said vacuum chamber substantially in parallel to the uppermost sheet, said belt being formed with a plurality of through holes for communicating with said vacuum chamber to draw the uppermost sheet by negative pressure in said vacuum chamber, said through holes being formed in a part of said endless belt at regular intervals along the sheet feeding direction, said second auxiliary nozzle means discharging the air jet towards said vacuum-feeding means in such a manner that the air jet first collides against said belt and then flows rearwardly toward the second and subsequent sheets, and wherein said endless belt rotates at different speeds according to rotational positions of the belt portion having no through holes.

4. An apparatus as claimed in claim 3, wherein said endless belt rotates at a higher speed when said belt portion having no through hole is passing over said vacuum chamber than when a belt portion having the through holes is passing over said vacuum chamber.

5. An apparatus as claimed in claim 3, wherein said vacuum-feeding means is located adjacent to means for conveying the sheet to feed the sheet to said conveying means by means of the endless belt, and said belt rotates at a speed substantially equal to a sheet conveying speed of said conveying means when a belt portion having the through holes is communicating with said vacuum chamber.

6. A sheet separating and feeding apparatus comprising: means for separating an uppermost sheet from piled sheets; means for vacuum-attracting and feeding said separated uppermost sheet; said separating means including main nozzle means and first auxiliary nozzle means for causing air to blow toward the sheets in an upper portion of the piled sheets horizontally and obliquely from a lower side thereof, respectively, to float the sheets upwardly in the upper portion of said piled sheets and separate the same from one another, and second auxiliary nozzle means for introducing an air jet between said uppermost sheet attracted onto said vacuum-attracting and feeding means and a second sheet just below the uppermost sheet to force the second and subsequent sheets downwardly, said vacuum-feeding means include a vacuum chamber located above the piled sheets and an endless belt rotating around said vacuum chamber substantially in parallel to the uppermost sheet, said belt being formed with a plurality of through holes for communicating with said vacuum chamber to draw the uppermost sheet of negative pressure in said vacuum chamber, said through holes being formed in a part of said endless belt at regular intervals along the sheet feeding direction, said second auxiliary nozzle means discharging the air jet towards said vacuum-feeding means in such a manner that the air jet first collides against said belt and then flows rearwardly toward the second and subsequent sheets, and wherein said endless belt is stopped once a leading end of a belt portion having the through holes reaches a position substantially corresponding to front edges of the piled sheets to attract the uppermost sheet.

7. An apparatus as claimed in claim 6, wherein said endless belt rotates at different speeds according to rotational positions of said belt portion having the through holes.

8. A sheet separating and feeding apparatus comprising: means for separating an uppermost sheet from piled sheets; means for vacuum-attracting and feeding said separated uppermost sheet; said separating means including main nozzle means and first auxiliary nozzle means for causing air to blow toward the sheets in an upper portion of the piled sheets horizontally and obliquely from a lower side thereof, respectively, to float the sheets upwardly in the upper portion of said piled sheets and separate the same from one another, and second auxiliary nozzle means for introducing an air jet between said uppermost sheet attracted onto said vacuum-attracting and feeding means and a second sheet just below the uppermost sheet to force the second and subsequent sheets downwardly, said vacuum-feeding means include a vacuum chamber located above the piled sheets and an endless belt rotating around said vacuum chamber substantially in parallel to the uppermost sheet, said belt being formed with vacuum chamber to draw the uppermost sheet by negative formed in a part of said endless belt at regular intervals along the sheet feeding direction, said second auxiliary nozzle means discharging the air jets towards said vacuum-feeding means in such a manner that the air jet first collides against said belt and then flows rearwardly toward belt is stopped at a position where leading through holes are not passing over a front edge of the uppermost sheets so that said leading through holes attract the front edge portion of the uppermost sheet.

9. An apparatus as claimed in claim 8, wherein said endless belt rotates at different speeds according to rotational positions of a belt portion having no through hole.

10. An apparatus as claimed in claim 8, wherein said second auxiliary nozzle means is so directed that the air jet collides against a belt portion having no through hole of the belt when said belt is stopping.

11. A method of separating an uppermost sheet from piled sheets by using sheet separating means, and vacuum-attracting the uppermost sheet onto rotatable feeding means to feed the sheet to conveying means, said separating means causing compressed air to blow to an upper portion of the piled sheets, said vacuum feeding means having a plurality of holes provided in a part of said vacuum feeding means for intermittently communicating with a negative pressure source, comprising the steps of:

locating said vacuum feeding means at a position where leading ones of said holes are substantially aligned with front edges of the piled sheets with respect to a direction of feeding of the sheets;

operating said separating means and vacuum feeding means to separate the uppermost sheet and allow said vacuum feeding means to attract the uppermost sheet;

rotating said vacuum feeding means holding the uppermost sheet attracted thereto at a speed substantially equal to a conveying speed of said conveying means;

rotating said vacuum feeding means at a speed faster than the conveying speed of said conveying means after the sheet attracted to the vacuum feeding means has reached said conveying means and communication between said holes and said negative pressure source has substantially lost; and rotating said vacuum feeding means again at a speed substantially equal to the conveying speed of said conveying means when said vacuum feeding means has again reached said position.

12. A method as claimed in claim 11, further, comprising the step of once stopping said vacuum feeding means when said vacuum feeding means has reached said position, to allow said vacuum feeding means a next sheet uppermost in the piled sheets.

13. An apparatus for separating and feeding sheets one by one from piled sheets, comprising: hopper means for accommodating the sheets; vacuum feeding means for taking out an uppermost sheet from said hopper means and feeding the same to conveying means, said vacuum feeding means including a vacuum chamber and an endless belt having a plurality of through holes provided in a part of said belt and rotating for causing said through holes to intermittently communicate with a negative pressure in said vacuum chamber; means for separating the uppermost sheet from remaining sheets in said hopper means, said separating means including a compressed air plenum chamber, main nozzles and first auxiliary nozzles provided on said plenum chamber for causing air to blow to an upper portion of the piled sheets horizontally and obliquely from a lower side thereof, respectively, to float up sheets in the upper portion of the piled sheets and separate the same from one another, and second auxiliary nozzles provided on said plenum chamber for releasing an air jet so that the air jet first collides against said belt and flows back to second and subsequent sheets below the uppermost sheet to be introduced between the uppermost sheet attracted onto said belt and the second sheet below the uppermost sheet for pushing the second and subsequent sheets downwardly; and means for controlling a rotational speed of said belt such that said belt rotates at different speeds in accordance with rotational positions of a belt portion having no through holes.

14. An apparatus as claimed in claim 13, wherein said hopper means includes an elevator for lifting and lowering the sheets and means for detecting a height of the uppermost sheet, said elevator being so operative as to keep the height of the uppermost sheet at a constant level responsively to detection thereof by said detecting means.

* * * * *